US005386759A

United States Patent [19]

Onozuka et al.

[11] Patent Number: 5,386,759

[45] Date of Patent: Feb. 7, 1995

[54] FLYING OBJECT ACCELERATION METHOD BY MEANS OF A RAIL-GUN TYPE TWO-STAGE ACCELERATING APPARATUS

[75] Inventors: Masanori Onozuka; Yasushi Oda, both of Kobe, Japan

[73] Assignee: Mitsubishi Jukogyo Kabushiki Kaisha, Tokyo, Japan

[21] Appl. No.: 152,697

[22] Filed: Nov. 16, 1993

Related U.S. Application Data

[60] Division of Ser. No. 963,043, Oct. 19, 1992, abandoned, which is a continuation of Ser. No. 638,435, Jan. 7, 1991, abandoned.

[30] Foreign Application Priority Data

| | | | |
|---|---|---|---|
| Jun. 28, 1990 | [JP] | Japan | 2-168557 |
| Jun. 29, 1990 | [JP] | Japan | 2-169999 |
| Jul. 2, 1990 | [JP] | Japan | 2-172665 |
| Jul. 2, 1990 | [JP] | Japan | 2-172666 |
| Jul. 2, 1990 | [JP] | Japan | 2-172667 |
| Jul. 3, 1990 | [JP] | Japan | 2-174395 |
| Sep. 3, 1990 | [JP] | Japan | 2-230570 |

[51] Int. Cl.[6] ..... F41B 6/00

[52] U.S. Cl. ..... 89/8; 124/3

[58] Field of Search ..... 89/8; 124/3; 315/150; 376/101

[56] References Cited

U.S. PATENT DOCUMENTS

| | | | |
|---|---|---|---|
| 3,398,322 | 8/1968 | Guenther | 315/150 |
| 4,343,223 | 8/1982 | Hawke et al. | 89/8 |
| 4,484,106 | 11/1984 | Taylor et al. | 315/150 |
| 4,625,618 | 12/1986 | Howanick | 89/8 |
| 4,665,476 | 5/1987 | Masuda | 363/86 |
| 4,681,016 | 7/1987 | Creedon | 89/8 |
| 4,743,807 | 5/1988 | Christophorou et al. | 315/150 |
| 4,751,428 | 6/1988 | Christophorou et al. | 315/150 |
| 4,846,911 | 7/1989 | Tackett et al. | 89/8 |
| 4,858,513 | 8/1989 | Kemeny | 89/8 |
| 4,864,911 | 9/1989 | McKee et al. | 89/8 |
| 4,884,489 | 12/1989 | Zowarka et al. | 89/8 |
| 4,938,112 | 7/1990 | Hertzberg et al. | 89/8 |
| 4,961,366 | 10/1990 | Kemeny | 89/8 |
| 5,005,462 | 4/1991 | Jasper et al. | 89/8 |

FOREIGN PATENT DOCUMENTS

| | | | |
|---|---|---|---|
| 2-107993 | 4/1990 | Japan | 376/101 |

OTHER PUBLICATIONS

Honig, J. et al., "Hydrogen Pellet Acceleration with a Two-Stage System Consisting of a Gas Gun and a Fuseless Electromagnetic Railgun", J. Vac. Sci. Technol., vol. 4, No. 3, pp. 1106–1112.

Hawke et al., "Rail Accelerator Development for Ultra High Pressure Research", IEEE Transactions on Magnetics, vol. MAG 20, No. 2, Mar. 1984, p. 291.

Adams et al., "UV-Laser Triggering of Multi--Megavolt Gas Switches", IEEE Con. Rec. of 1982, 15th Modulator Symposium, 1982, pp. 79–83.

Kunitome et al., "Spark-Gap Switches Illuminated by KrF Laser Through UV Optical Fibers", IEEE Con. Rec. of 1982, 15th Modulator Symposium, 1982, pp. 110–112.

*Primary Examiner*—Stephen C. Bentley

*Attorney, Agent, or Firm*—Wenderoth, Lind & Ponack

[57] ABSTRACT

In a two-stage railgun accelerating apparatus, a flying object is initially accelerated by acceleration gas produced by a gas gun. The initially accelerated flying object is led through an introducing pipe to an inlet of a railgun section of the two-stage railgun accelerating apparatus. A position and a velocity of the flying object are detected by a position detector and a velocity detector provided in the introducing pipe. According to the results of detection, both a voltage is applied to the railgun section and the acceleration gas is irradiated just behind the flying object with a laser beam, such that a dielectric breakdown of the gas is effected to generate plasma of good quality for accelerating the flying object.

1 Claim, 11 Drawing Sheets

FLYING OBJECT ACCELERATION METHOD BY MEANS OF A RAIL-GUN TYPE TWO-STAGE ACCELERATING APPARATUS

This is a divisional application of Ser. No. 07/963,043, filed Oct. 19, 1992, now abandoned, which in turn is a continuation application of Ser. No. 07/638,435 filed Jan. 7, 1991 and now abandoned.

BACKGROUND OF THE INVENTION

1 . Field of the Invention

The present invention relates to a two-stage railgun accelerating apparatus for projecting an object at a super high speed.

2. Description of the Prior Art

One example of a two-stage railgun accelerating apparatus in the prior art is shown in FIGS. 21 to 24, and another example thereof is shown in FIGS. 25 and 26.

First, the two-stage railgun accelerating apparatus of the prior art shown in FIGS. 21 to 24 will be described. Reference numeral 1 in FIG. 21 designates a gas gun initial accelerating apparatus, reference numeral 2 in FIGS. 21 and 22 designates an introducing pipe, reference numeral 3 designates a pulse shaping network, numeral 4 designates plasma, numeral 5 in FIGS. 21 and 24 designates a flying object, numerals 6 designate rails, numeral 8 in FIG. 23 designates a needle, reference character $d_1$ in FIG. 24 designates an inner diameter of the introducing pipe 2 (nearly equal to an outer diameter of the flying object 5), reference character $d_2$ designates the diameter of the space between the rails 6 on the downstream side of the introducing pipe, and reference character $d_3$ designates the diameter of the space between the rails 6 downstream from the space on the downstream side of the introducing pipe. The needle 8 projects into the space between the rails 6 on the downstream side of the introducing pipe (the portion having an inner diameter $d_2$).

Next, the two-stage railgun accelerating apparatus of the prior art shown in FIGS. 25 and 26 will be described. Reference numeral 2 designates an introducing pipe, numeral 5 designates a flying object, numerals 6 designate rails, numeral 8 designates a needle, reference character $d_1$ designates an inner diameter of the introducing pipe 2 (nearly equal to an outer diameter of the flying object 5), and reference character $d_4$ designates a diameter of the space between the rails 6 (nearly equal to an outer diameter of the flying object 5). The needle 8 is embedded and does not project into the space on the downstream side of the introducing pipe.

Now, the operations of the two-stage railgun accelerating apparatuses shown in FIGS. 21 to 24 and in FIGS. 25 and 26, respectively, will be described. The flying object 5 projected from the gas gun initial accelerating apparatus 1 is injected from the introducing pipe 2 into the space between the rails 6 while being subjected to initial acceleration by the expansion of acceleration gas. When it passes by the needle 8, a voltage is applied from a discharging power supply 10 through the needle 8 to the acceleration gas behind the flying object 5. Hence, the acceleration gas behind the flying object 5 is broken down, resulting in a transformation of the acceleration gas into plasma 4. This plasma 4 is accelerated by an electromagnetic force (Lorentz force) generated by an electric current produced by a voltage applied between the pair of rails 6 by means of the pulse shaping network 3, and by a magnetic field produced by the plasma itself, whereby the flying object 5 positioned in front of this plasma 4 is additionally accelerated.

Furthermore, the details of the rails in the prior art will be described with reference to FIG. 27. In this figure, reference numeral 01 designates rails having a nearly trapezoidal cross section in a railgun portion, numeral 02 designates insulators interposed between the respective rails 01 and having a nearly trapezoidal cross section, and numeral 03 designates seal members interposed between inclined surfaces of the respective insulators 02 and the adjacent rails 01. The rails 01 having a trapezoidal cross section and the insulators 02 having a trapezoidal cross section are alternately disposed with the seal members 03 being interposed between adjoining surfaces of these members 01 and 02. A flying object passageway having a circular cross section conformed to the cross-sectional shape of the flying object is formed within these members 01 and 02.

FIG. 28 shows another example of the flying object passageway of the railgun portion in the prior art. In this case, flat plate-shaped rails 01 and insulators 02 having a shallow T-shaped cross section are alternately disposed. Seal members 03 are interposed between the adjacent members, whereby a flying object passageway having a rectangular cross section conformed to the cross-sectional shape of the flying object is formed.

In the heretofore known two-stage railgun accelerating apparatus illustrated in FIGS. 21 to 24 there were problems in that (1) since the needle 8 projects into the space between the rails 6 at the downstream side of the introducing pipe (the portion having an inner diameter $d_2$), the flying object 5 injected from the introducing pipe 2 into the space between the rails 6 would collide against the needle 8, resulting in a breakdown of or damage to the flying object 5, (2) since the flying object 5 having an outer diameter nearly equal to the inner diameter $d_1$ of the introducing pipe 2 is injected into the space between the rails 6 having a larger diameter than the diameter $d_1$ (the space having a diameter $d_2$), the plasma would leak around the flying object 5, and hence the flying object 5 could not be additionally accelerated effectively, and (3) the probability of the flying object 5 entering the space between the rails 6 having a diameter close to the outer diameter of the flying object 5 (the space having a diameter $d_3$) after it had been injected into the space between the rails 6 on the downstream side of the introducing pipe (the space having an inner diameter $d_2$), was slim.

In the heretofore known type two-stage railgun accelerating apparatus illustrated in FIGS. 25 and 26, there were problems in that: (1) since the needle 8 is embedded and an electric field concentrates at the tip end of the needle 8, a uniform discharge could hardly be obtained, and (2) there was a possibility of a discharge occurring from the needle 8 towards one of the rails 6, in which case the operation would become unstable.

Another problem common to the known two-stage railgun accelerating apparatus shown in FIGS. 21 to 24 and the known two-stage railgun accelerating apparatus shown in FIGS. 25 and 26, is that because the plasma 4 is generated in the accelerating gas behind the flying object 5 by means of the needle 8, unless the pressure of the accelerating gas and the voltage applied to the needle (electrode) 8 are adjusted appropriately, the accelerating gas will not break down and a transformation of the gas into plasma 4 will not occur. As is the case with these two-stage railgun accelerating apparatuses in which the accelerating gas is transformed into plasma 4 by applying a voltage to the needle 8, the relations among the pressure of the accelerating gas, the applied voltage and the distance between the electrodes generally follow Paschen's Law (see FIG. 29). Accordingly, in the case where the distance between the electrodes is constant, unless the pressure of the accelerating gas is lowered to a certain extent, the necessary voltage to be applied would not become sufficiently low. On the contrary, if the pressure of the accelerating gas is high, the necessary voltage to be applied is high, and hence a large-capacity discharging power supply 10 becomes necessary. It is to be noted that suppressing the pressure of the accelerating gas to a low value would become a negative factor in realizing a fast flying object speed because the initial acceleration of the flying object 5 would be correspondingly low.

The above-described problems can be summarized as follows:

(i) Suppressing the applied voltage. —It is necessary to lower the pressure of the accelerating gas so that a voltage which will generate plasma can be applied. The lowering of the pressure of the gas is accompanied by a corresponding lowering of the initial speed of the flying object.

(ii) Raising the accelerating gas pressure. —It is necessary to apply a high voltage if the accelerating gas pressure is so high as to impart a sufficiently high speed to the object. —A large-capacity discharging power supply 10 is necessary to apply such a high voltage.

(iii) If the accelerating gas pressure is high, a high voltage is necessary. —A high voltage damages (erodes) the rails 6, and thus shortens the life of the rails 6.

For instance, in the case where helium (He) gas is to undergo dielectric breakdown at an interelectrode distance of 2 mm, and under a gas pressure of 50 Torr, according to Paschen's Law, the transformation of the gas into plasma can be generated by applying a dielectric breakdown voltage of about 200 V to the gas. But at this gas pressure, a sufficient initial acceleration of a flying object cannot be achieved. Accordingly, if the gas pressure is set at 5,000 Torr, that is, if the gas pressure is raised to such an extent that a sufficient initial acceleration can be achieved, then the voltage necessary for effecting dielectric breakdown is about 3,000 V, and the power supply must therefore have a large-capacity.

In addition, in the heretofore known two-stage railgun accelerating apparatus shown in FIGS. 21 to 24 as well as in the heretofore known two-stage railgun accelerating apparatus shown in FIGS. 25 and 26, in the case where the accelerating gas pressure is so low as to facilitate the generation of the plasma 4 with a moderate voltage, according to Paschen's Law dielectric breakdown is apt to occur in a selected portion of the space between the rails 6. This implies that dielectric breakdown would not occur at all portions, and consequently, there was a problem in that acceleration of the plasma 4 and of the flying object 5 could not be achieved.

Moreover, the plasma 4 generated in the above-described respective two-stage railgun accelerating apparatuses had a relatively low density and degree of ionization, and consequently, the efficiency under which the flying object 5 was accelerated was low.

Furthermore, in the heretofore known two-stage railgun accelerating apparatus shown in FIG. 27, rails 01 having a nearly trapezoidal cross section and insulators 02 having a nearly trapezoidal cross section are disposed alternately and seal members 03 are interposed between their adjoining surfaces to form a flying object passageway having a circular cross section. Hence, an inter-rail distance at the rail corner portions is small. This results in a large electric potential gradient at the corner portions and a concentration of plasma thereat. In addition, due to such reasons, electric currents would concentrate at the corner portions of the rails 01. As a result, the corner portions of the rails 01 are locally heated by Joule's heat due to the electric currents and the thermal radiation of the plasma 4, and this causes the rails to erode.

Also, in the heretofore known two-stage railgun accelerating apparatus shown in FIG. 28, flat plate-shaped rails 01 and insulators 02 having a shallow T-shaped cross section are alternately disposed, and seal members 03 are interposed between their adjoining surfaces to form a flying object passageway having a rectangular cross section. Hence, an inter-rail distance at the rail corner portions is uniform, and it seems that a concentration of plasma would hardly occur. But, because the flying object 5 has acute corner portions, a sealing of the plasma behind the flying object in the rails is poor.

In summary, in the case of the structure shown in FIG. 27, in view of erosion a current density cannot be increased. Also, in the case of the structure shown in FIG. 28, in view of the poor sealing property, a large quantity of plasma passes through the gaps between the flying object 5 and the rails 6. Therefore, both the structures shown in FIGS. 27 and 28 have a problem in that the flying object 5 cannot be additionally accelerated efficiently.

It is to be noted that if an accelerating force for the flying object 5 is represented by F, a mass of the flying object 5 is represented by m, an acceleration is represented by a, a rail inductance is represented by L, a velocity of the flying object 5 is represented by V, an accelerating time is represented by t and a current flowing through the rails and the plasma is represented by I, then the following relations are fulfilled:

$$F = ma,$$

$$F = \frac{1}{2} L_1 I^2$$

$$V = V_o +$$

where $V_o$ represents an initial velocity obtained by the initial acceleration.

SUMMARY OF THE INVENTION

The present invention has been developed in view of the above-mentioned problems in the prior art, and one object of the present invention is to provide a two-stage railgun accelerating apparatus, by which the stability of a flying object can be insured, additional acceleration of a flying object can be achieved effectively, matching of acceleration for a high-speed flying object can be effected easily, and acceleration is carried out highly efficiently.

According to one feature of the present invention, there is provided a method of accelerating a flying object by means of a two-stage railgun accelerating apparatus, wherein a flying object is initially accelerated by acceleration gas in a gas gun type of initial accelerating apparatus, the object is led by an introducing pipe to an inlet of a railgun section of the accelerating apparatus, a position and a velocity of the flying object are detected by a position detector and a velocity detector or the like provided in the introducing pipe, and depending upon the results of detection, either a voltage is applied to the railgun section and the acceleration gas is irradiated just behind the flying object with a laser beam or the acceleration gas just behind the flying object is irradiated with a laser-beam and a voltage is applied to the railgun section immediately after the irradiation. Accordingly, a dielectric breakdown of the acceleration gas is effected to produce plasma of good quality. This plasma is used as an armature in the railgun section.

According to another feature of the present invention, there is provided a two-stage railgun accelerating apparatus, wherein a pair of rails and a pair of insulators are alternately disposed and seal members are interposed between the rails and the insulators to form a flying object passageway, an inter-rail distance at the respective rail corner portions is relatively small, the circumferential portions of the rails where current and plasma concentrates is considerably large, and the flying object passageway is curved including at the rail corner portions.

In order to prevent the erosion of the rails and the leakage of plasma to the front of the flying object, the present invention provides one or more of the following effects:

(1) The concentration of current and plasma is prevented by eliminating large differences in the inter-rail distance across the flying object passageway (Anti-erosion).

(2) The concentration of heat is avoided by providing considerably large circumferential portions of the rails defining the flying object passageway (Anti-erosion).

(3) The leakage of plasma to the front of the flying object is prevented by forming curved portions at the corners of the flying object and at the flying object passageway in the railgun section (Anti-through-away).

According to the effect (1) above, differences in electric potential between the rails are small and so a concentration of plasma can be prevented. In addition, at the same time, a concentration of rail current leading to the plasma is prevented, whereby erosion caused by locally concentrated heating is prevented. It is to be noted that if the differences in inter-rail distance were large, plasma would concentrate at the rail corner portions where there would be a small inter-rail distance (having a large potential gradient), and a seal current would also concentrate there.

According to the effect (2) above, in the event that rail corner portions are heated by concentration to a certain extent of the current and plasma, the angle at the corner portions is enlarged to prevent a concentration of heat, whereby erosion is reduced.

According to the effect (3) above, since a sealing force between the flying object and the rails is considered to be weakest at the corner portions of the flying object, curved portions are formed at the corners of the flying object and at the flying object passageway of the railgun section, whereby sealing at the corner portions is ensured.

By combining the above-described effects, a flying object can be additionally accelerated in an efficient manner.

DETAILED DESCRIPTION OF THE PREFERRED EMBODIMENTS

Figure 1:
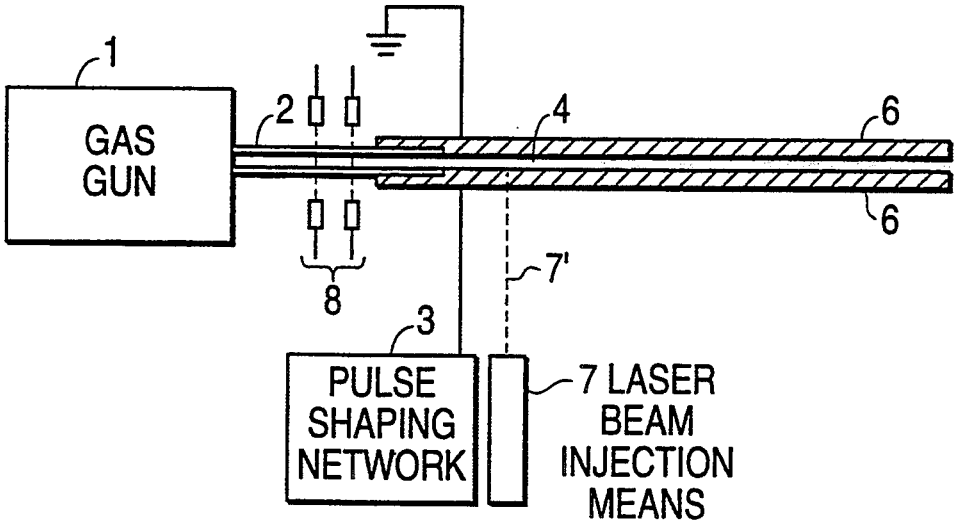
FIG. 1 is a schematic diagram of one embodiment of a type two-stage railgun accelerating apparatus according to the present invention.

Now one example of a two-stage railgun accelerating apparatus to be used for carrying out the flying object acceleration method according to the present invention will be described with reference to FIGS. 1 to 3. In these figures, reference numeral 1 designates a gas gun type of initial accelerating apparatus, numeral 2 designates an introducing pipe, numeral 3 designates a pulse shaping network, numeral 4 designates plasma, numeral 5 designates a flying object, numeral 6 designates the rails of a two-stage railgun accelerating apparatus, and numeral 8 designates a flying object position/velocity detector provided in the introducing pipe 2 for detecting the position and velocity of the flying object 5. In addition, reference numeral 7 designates laser beam injection means disposed in the proximity of the pulse shaping network 3 for projecting a laser beam into acceleration gas behind the flying object 5. The irradiation of the acceleration gas with this laser beam 7' is efficiently carried out under good timing behind the flying object 5, according to the position and velocity of the flying object 5 detected by the flying object position/velocity detector 8. Also, a voltage may be applied to the railgun section according to the results of detection by the flying object position/velocity detector 8. In addition, reference character $d_1$ designates an inner diameter of the introducing pipe 2 (nearly equal to an outer diameter of the flying object 5), and reference character $d_4$ designates the diameter of the space between the rails 6 (nearly equal to an outer diameter of the flying object 5).

Next, the operation of the two-stage railgun accelerating apparatus shown in FIGS. 1 to 3 will be explained in detail. A flying object 5, ejected by acceleration gas in the gas gun type of initial accelerating apparatus 1, is injected through the introducing pipe 2 into the space between the rails 6 while it is being initially accelerated by the expansion of the acceleration gas. At this moment, the position and velocity of the flying object 5 are detected by the flying object position/velocity detector 8 provided in the introducing pipe 2. According to the results of detection, a laser beam 7' is projected by the laser beam injection means 7 into the acceleration gas behind the flying object. Hence, the acceleration gas is optically excited, and the dielectric breakdown of the acceleration gas behind the flying object 5 is triggered such that plasma of good quality (plasma having a high density, a large degree of ionization and good electrical conductivity) is produced. This plasma is used as a plasma armature in the railgun section, and the plasma and the flying object 5 are additionally accelerated.

Comparative data of a railgun in the prior art (data at the Illinois University in the U.S.A.) and of the laser-excited railgun are shown in the following table.

| Item | Railgun in the prior art | Laser-excited railgun |
|---|---|---|
| Initial pressure of a gas-gun | 42 kgf/cm$^2$ (600 psi) | 55 kgf/cm$^2$ |
| Inlet pressure of a railgun | 3.08 kgf/cm$^2$ | 5–10 kgf/cm$^2$ |
| Necessary dielectric breakdown voltage | 2 KV | 3–6 KV |
| Maximum voltage | 10 KV | 2.5 KV |
| Maximum current | 23.5 KA | 88 KA |
| Primary acceleration | 800 m/s | 350 m/s |
| Final velocity | 2.2 km/s | 1.8 km/s |
| Conditions | Real pellet (real flying object) $SH_2$ in vacuumm | Dummy pellet (dummy flying object) plastics under atmospheric pressure |

As shown above, plasma can be generated by a laser beam even if the acceleration gas pressure is high. That is, the dielectric breakdown voltage can be high, and therefore, additional acceleration can be carried out efficiently without producing a secondary discharge behind the armature. In addition, since it is possible to produce plasma of good quality having a high density and a large degree of ionization, and to accelerate this plasma, acceleration efficiency is improved (that is, acceleration is facilitated even in the atmosphere, and even for a flying object having a large mass, and even when there is a low initial velocity and a low voltage, a high velocity can be obtained).

Figure 2:
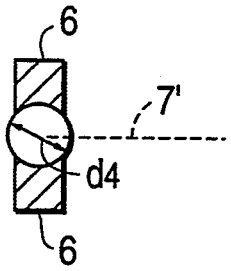
FIG. 2 is a schematic diagram of the rails in cross section showing the state of incidence of a laser beam.
Figure 3:
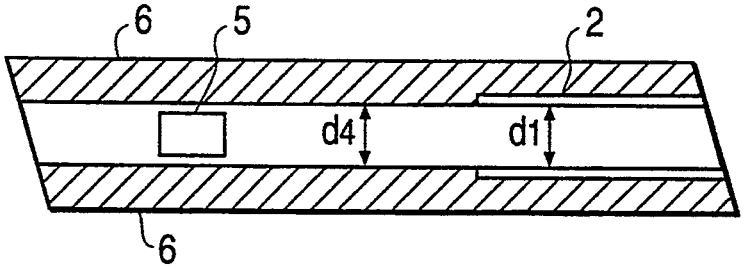
FIG. 3 is a longitudinal sectional view of an introducing pipe and rails.
Figure 4:
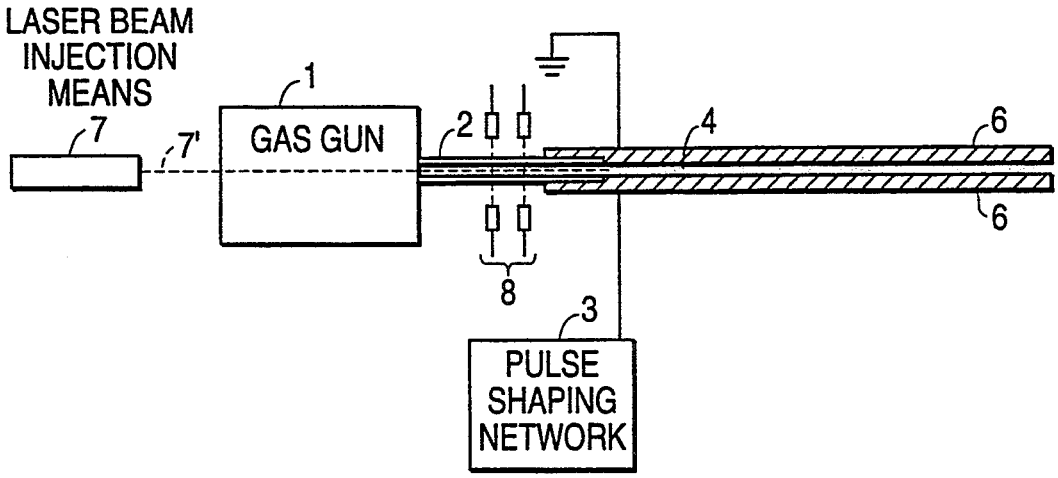
FIG. 4 is a schematic diagram of another embodiment of the two-stage railgun accelerating apparatus.

FIG. 4 shows another preferred embodiment of the present invention, which is similar to the above-described embodiment shown in FIGS. 1 to 3 except for the fact that the laser beam injection means 7 is disposed behind the gas-gun type of injection apparatus 1 to project a laser beam 7' into the acceleration gas behind the flying object 5 between the same gas-gun type flying object injection apparatus 1 and the rails 6. This embodiment operates similar to that described above.

Next, the flying object passageway in the railgun section of the railgun accelerating apparatus according to the present invention will be described in more detail with reference to respective preferred embodiments.

Figure 5:
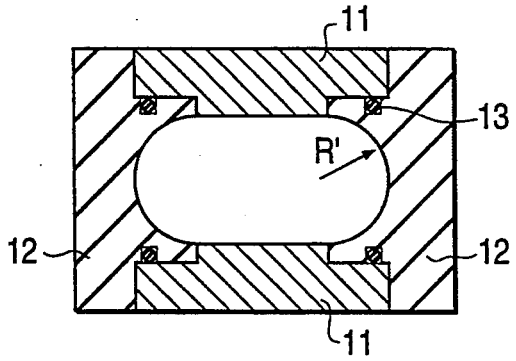
FIG. 5 is a vertical cross-sectional view of one preferred embodiment of a flying object passageway in a railgun section.
Figure 28:
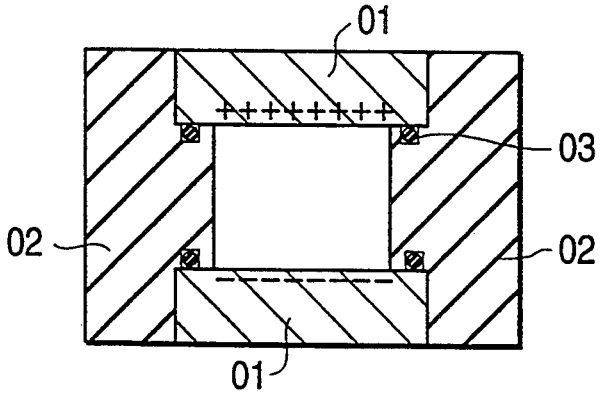
Figure 29:
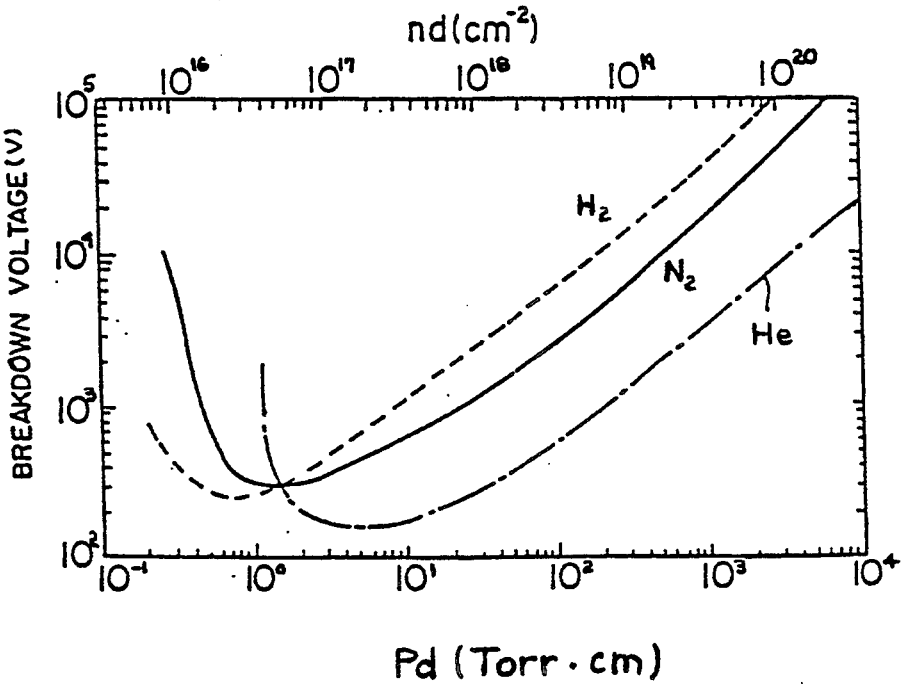
FIG. 29 is a diagram graphically illustrating Paschen's Law.

FIG. 5 shows one preferred form of the rails which provides the previously described effects (1) and (3) according to the present invention. In this figure, reference numeral 11 designates rails having a shallow T-shaped cross section, numeral 12 designates insulators having a shallow T-shaped cross section, and numeral 13 designates seal members. These rails 11 and insulators 12 are alternately disposed and engaged with each other, and between the rails and the insulators 12 are interposed the seal members 13 to form a plasma passageway having an oval cross section. In this case, because the inter-rail distance is constant, the rail current and plasma are generated uniformly. Hence, local heating will not occur and erosion can be prevented effectively. In addition, as a joint effect with the fact that the cross section of the plasma passageway is not rectangular, as is the case with the structure shown in FIG. 28, but is oval, acute corner portions are not formed on the flying object and hence, the plasma seal property is excellent.

In the illustrated embodiment, the inter-rail distance is constant. Whereas, in the heretofore known example shown in FIG. 27, a difference in inter-rail distance is $2_r$, wherein $_r$=R (1−cos $\theta$), R is a radius of the space between the rails and $\theta$ represents a rail angle (see FIG. 27). Accordingly, plasma (discharge) will not concentrate at the rail edges in the present invention, whereby rail current will not be concentrated. Hence, local heating is pre vented, and an anti-erosion property is improved. Also, as compared to the case of the flying object passageway having a rectangular cross section shown in FIG. 28, owing to the provision of the curved portions forming the oval shape, plasma is better sealed behind the flying object in the railgun section. For the above-mentioned reasons, it is possible to apply a larger current. Furthermore, the amount of plasma flowing around the flying object is also reduced. And, the flying object can be additionally accelerated in an efficient manner.

Figure 6:
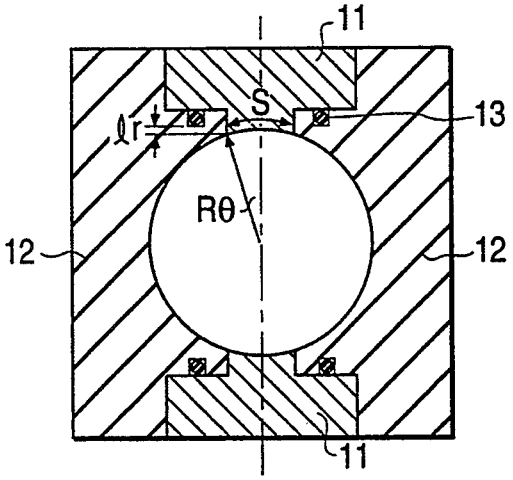
FIG. 6 is a vertical cross-sectional view of another preferred embodiment of the flying object passageway.

FIG. 6 shows another preferred embodiment which provides the previously described effects (2) and (3) according to the present invention. In this figure, rails 11 having a shallow T-shaped cross section and insulators 12 having a shallow T-shaped cross section are alternately disposed and engaged with each other, and seal members 13 are interposed between the rails 11 and the insulators 12 to form a plasma passageway having a circular cross section. In this case, while the inter-rail distance varies across the passageway, the maximum difference is small. Moreover, as compared to the structure shown in FIG. 27, since an angle of the corner portion is large, local heating can be avoided. It is to be noted that the cross section of the plasma passageway is circular, and because the flying object does not have acute corner portions, plasma is well sealed behind the object in the plasma passageway.

Figure 27:
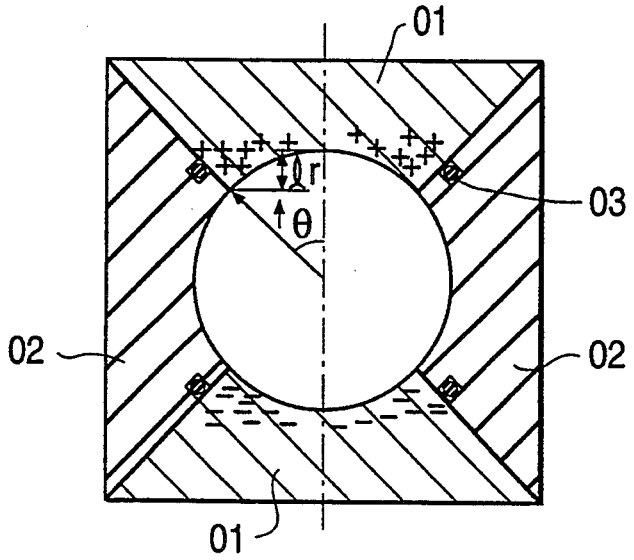
FIG. 27 PRIOR ART
FIGS. 27 and 28 are vertical cross-sectional views, respectively, of different examples of a flying object passageway in a railgun section in the prior art.

In this preferred embodiment, although there are differences in the inter-rail distance, the structure is improved as compared to the heretofore known example shown in FIG. 27. And in this case, since the flying object passageway has a circular cross section, it effects a plasma seal between the passageway and the flying object which is equivalent to that effected by the structure shown in FIG. 27, but which is considerably improved as compared to that effected by the structure shown in FIG. 28. Therefore, the flying object can be additionally accelerated in an efficient manner similarly to the preferred embodiment illustrated in FIG. 5.

Figure 7:
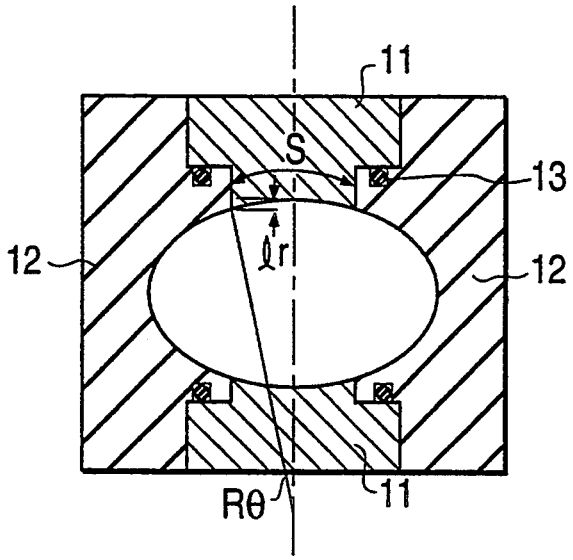
FIG. 7 is a vertical cross-sectional view of still another preferred embodiment of the flying object passageway.

FIG. 7 shows still another preferred embodiment which provides the previously described effects (2) and (3) according to the present invention. In this figure, rails 11 having a shallow T-shaped cross section and insulators 12 having a shallow T-shaped cross section are alternately disposed and engaged with each other, and seal members 13 are interposed between the rails 11 and the insulators 12 to form a plasma passageway having an elliptical cross section. In this case, while the inter-rail distance varies across the passageway, the variations are small as in the embodiment shown in FIG. 6. Moreover, since the length s in the circumferential direction of the inner surfaces of the rails can be made large as compared to the case shown in FIG. 6, when a current is applied thereto, a plasma and current density per unit rail length is reduced, whereby an erosion suppressing effect larger than that in the case shown in FIG. 6 can be obtained.

In this preferred embodiment also, the flying object can be additionally accelerated in an efficient manner similarly to the preferred embodiments shown in FIGS. 5 and 6, respectively.

Figure 8:
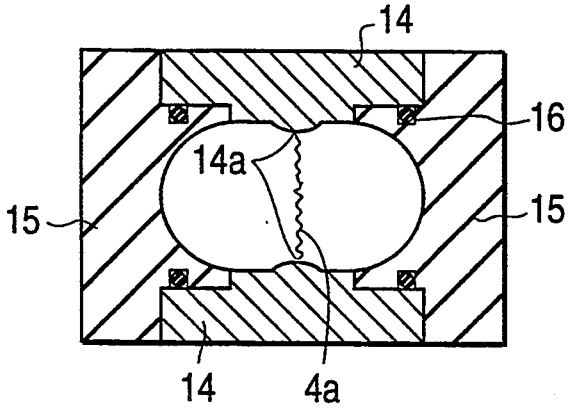
FIG. 8 is a vertical cross-sectional view of yet another preferred embodiment of the flying object passageway.

In the preferred embodiment shown in FIG. 8, reference numeral 14 designates rails in a railgun section of a railgun accelerating apparatus, and numeral 15 designates insulators interposed between the rails 14. A flying object passageway having a generally oval cross section is formed by the rails 14 and the insulators 15. And, at the central portions of the respective rails 15 are formed protrusions **14*a* projecting towards the opposed rails, so that the inter-rail distance between the rails 14** is minimal at the central portions.

Now, the advantages of the railgun accelerating apparatus shown in FIG. 8 will be explained in detail. Owing to the fact that protrusions projecting towards the opposed rails are formed at the central portions of the rails 14 to make the inter-rail distance between the rails 14 minimal at the central portions of the rails 14, the following effects and advantages are obtained:

(i) Since main plasma **4*a* is produced at the central portion of the flying object passageway, erosion of the insulators 15** can be prevented.

(ii) Since the main plasma **4*a* is produced at the central portion of the flying object passageway as described above, a moment is not generated at the flying object, and frictional resistance is reduced. In addition, as the position of generation of the main plasma 4*a*** is fixed, variations in the internal stress of the flying object are small, and so cracking and breakdown of the flying object can be prevented.

(iii) The leaking of plasma to the front of the flying body can be prevented because the main plasma **4*a* is concentrated at the rear of the flying object. More particularly, while the mostly accelerated main plasma 4*a* is passing through the gap between the flying object and the rails 14 and insulators 15 to the front of the flying object, it is electrically insulated at the gap between the flying object and the rails 14**. Hence, the plasma is transformed to neutral gas, and as it is decelerated by a viscous resistance, the passing of the plasma to the front of the flying object can be prevented.

(iv) In manufacturing the railgun section, it is only necessary to apply a heat-resistive coating to the protrusions at the center of the rails 14, and so, the manufacture of the railgun section consisting of the rails 14 and the insulators 15 can be effected easily.

Figure 9:
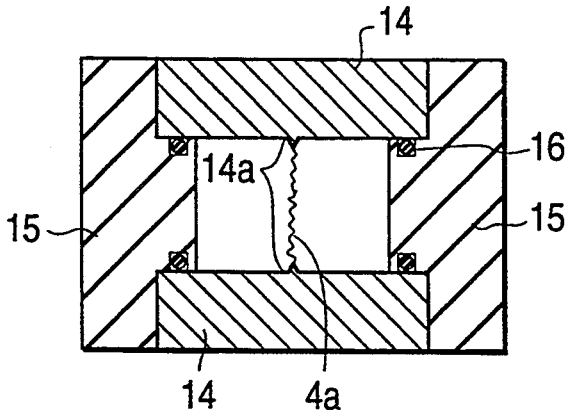
FIG. 9 is a vertical cross-sectional view of a further preferred embodiment of the flying object passageway.

FIG. 9 shows a still further preferred embodiment of the present invention, in which flat plate-shaped rails 14 and insulators 15 having a shallow T-shaped cross section are alternately disposed, and seal members 16 are interposed between adjoining surfaces of these members to form a flying object passageway having a rectangular cross section. At the central portions of the flat plate-shaped rails 14 are provided protrusions **14*a* projecting towards the opposed rails 14, whereby the inter-rail distance between the rails 14** is minimal at their central portions. This preferred embodiment possesses advantages similar to those described above.

Figure 10:
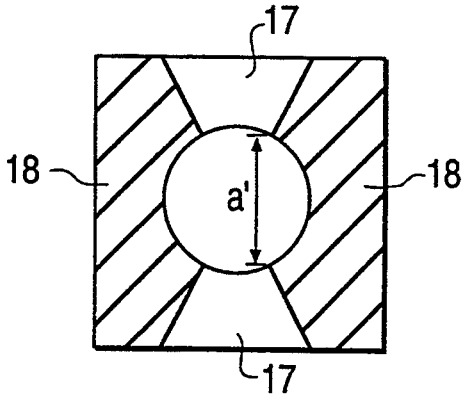
FIG. 10 is a vertical cross-sectional view of an inlet portion of a railgun section according to one preferred embodiment of the present invention.
Figure 11:
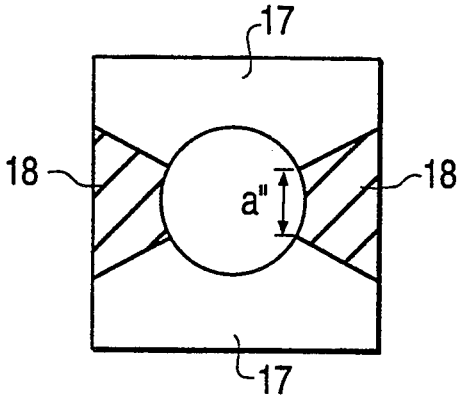
FIG. 11 is a vertical cross-sectional view of an outlet portion of the same railgun section.

In a further preferred embodiment shown in FIGS. 10 and 11, reference numeral 17 designates rails in a railgun section of a railgun type accelerating apparatus, numeral 18 designates insulators interposed between the rails 17, and a flying object passageway having a circular cross section is formed by the rails 17 and the insulators 18. The inter-rail distance at the respective rail corner portions decreases in the downstream direction of the moving plasma. More particularly, reference character a′ in FIG. 10 represents an inter-rail distance at the respective rail corner portions in the inlet portion of the flying object passageway, reference character a″ in FIG. 11 represents an inter-rail distance at the respective rail corner portions in the outlet portion of the flying object passageway, and a relation of $a' > a''$ is satisfied. However, the cross-sectional shape of the flying object passageway is the same over the entire length of the flying object passageway.

Next, the advantages of the railgun accelerating apparatus shown in FIGS. 10 and 11 will be explained in detail. Since the inter-rail distance at the respective rail corner portions of the rails 17 decreases in the downstream direction of the moving plasma (note a'>a''), a resistance r of the plasma is also reduced in the same direction. Hence, a current I flowing through the rails 17 and the plasma increases in the downstream direction of the moving plasma and an electromagnetic force is also enhanced, so that the flying object can be additionally accelerated in an efficient manner. In addition, since the inter-rail distance at the respective rail corner portions of the rails 17 decreases in the downstream direction of the moving plasma and the resistance r of the plasma is also reduced in the same direction, the current I flows more readily through the plasma. Therefore, a surplus discharge will hardly be generated behind the flying object.

Figure 12:
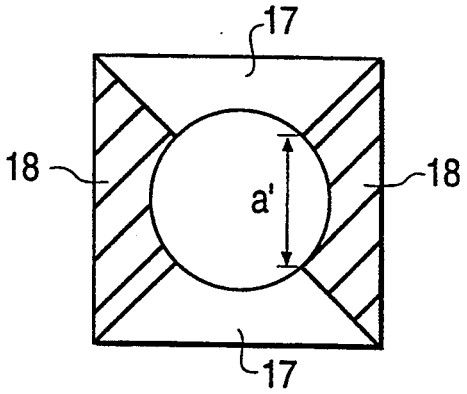
FIG. 12 is a vertical cross-sectional view of an inlet portion of a railgun section according to another preferred embodiment of the present invention.
Figure 13:
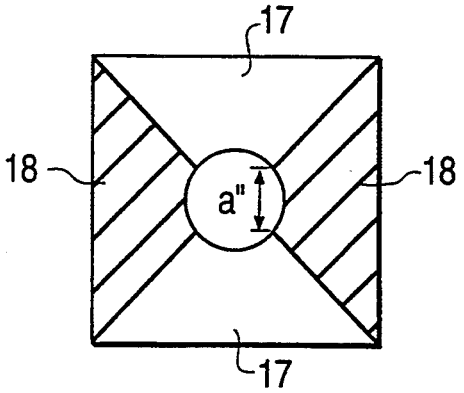
FIG. 13 is a vertical cross-sectional view of an outlet portion of the same railgun section.

Next, the railgun accelerating apparatus according to the present invention will be described in connection with still another preferred embodiment shown in FIGS. 12 and 13. In this preferred embodiment, a flying object passageway having a circular cross section is formed by a pair of rails 17 and a pair of insulators 18. The inter-rail distance at the respective rail corner portions decreases in the downstream direction of the moving plasma. More particularly, reference character a' in FIG. 12 represents the inter-rail distance at the respective rail corner portions in the inlet portion of the above-mentioned flying object passageway, reference character a'' in FIG. 13 represents the inter-rail distance at the respective rail corner portions in the outlet portion of the above-mentioned flying object passageway, and a relation of a'>a'' is satisfied. However, the cross-sectional area of the flying object passageway decreases in the downstream direction of the moving plasma.

Now, the advantages of the railgun accelerating apparatus shown in FIGS. 12 and 13 will be explained in detail. In this preferred embodiment, the inter-rail distance at the respective corner portions of the rails 17 decreases in the downstream direction of the moving plasma (note a'>a''). Accordingly, the resistance E of the plasma is also reduced in the same direction. Hence, the current I flowing through the rails 17 and the plasma increases in the downstream direction of the moving plasma, and an electromagnetic force is also enhanced, so that the flying object will be additionally accelerated in an efficient manner. In addition, in this particular preferred embodiment, since the cross-sectional area of the flying object passageway decreases in the downstream direction of the moving plasma, even if the flying object should be damaged (mainly abraded), a seal would be insured between the flying object and the flying object passageway. As a result, the disadvantageous condition in which the plasma behind the flying object leaks to the front of the flying object through the gap between the flying object and the flying object passageway, and in which only the plasma in front of the flying object is thus subjected to an electromagnetic force and thereby accelerated, but in which the flying object is not accelerated, would not occur.

Figure 14:
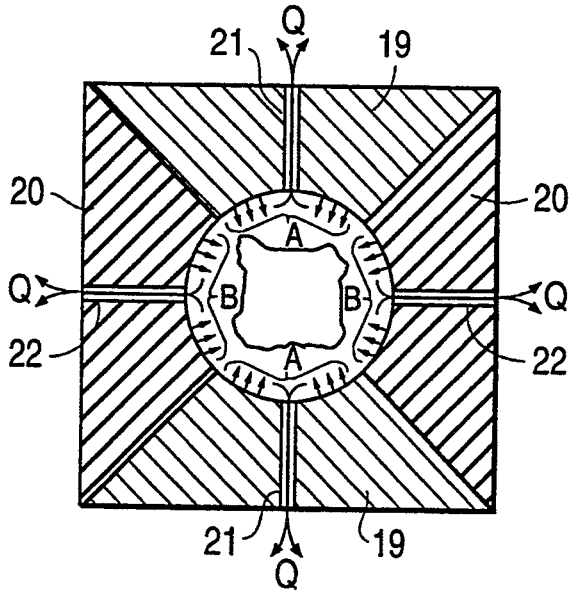
FIG. 14 is a vertical cross-sectional view of still another preferred embodiment of the flying object passageway.

In a further preferred embodiment shown in FIG. 14, reference numeral 19 designates rails in the railgun section of the railgun accelerating apparatus, numeral 20 designates insulators interposed between the rails 19, and a flying object passageway having a circular cross section is formed by the rails 19 and the insulators 20. Impurity ejecting holes 21 and 22 are drilled in the respective rails 19 and the respective insulators 20.

Now, the advantages of the railgun accelerating apparatus shown in FIG. 14 will be explained in detail. As a result of the fact that high-temperature plasma comes into contact with the inner surfaces of the rails 19 and the insulators 20, impurities A and B in the form of gas are released from the inner surfaces of the rails 19 and the insulators 20 into the flying object passageway as shown by arrows. That is, as a result of the sublimation of the materials of the rails 19 and insulators 20, impurities A and B in the form of gas are released. These impurity gases A and B are exhausted from the flying object passageway through the impurity ejecting holes 21 and 22 to the outside of the railgun section as indicated by arrows Q.

Figure 15:
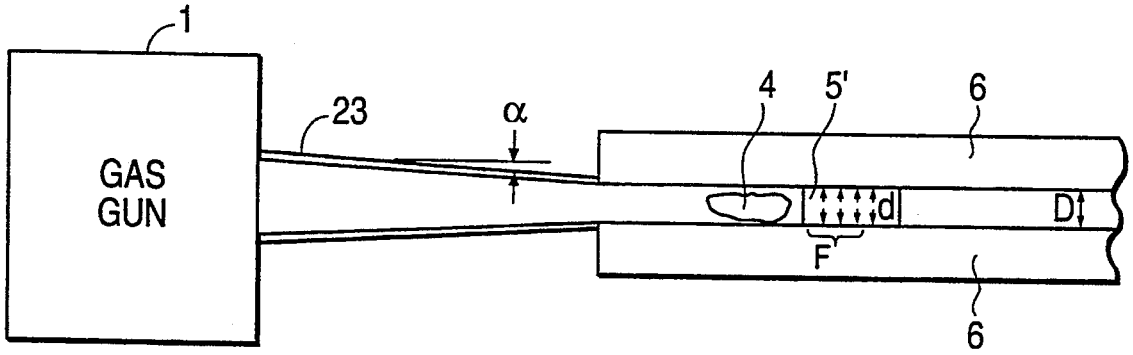
FIG. 15 is a schematic diagram of yet a further preferred embodiment of the two-stage railgun accelerating apparatus.

In yet another preferred embodiment shown in FIG. 15, reference numeral 1 designates a gas gun type of initial accelerating apparatus, numerals 6 designate rails of a railgun section of the apparatus, and numeral 23 designates a tapered introducing pipe having an angle of taper $\alpha$ which is most characteristic of this particular preferred embodiment. The tapered introducing pipe 23 connects the above-mentioned gas gun type of initial accelerating apparatus 1 with the above-mentioned rails 6 of the railgun section. In addition, reference numeral 4 designates plasma which is produced and accelerated in the railgun section.

Next, the two-stage railgun accelerating apparatus shown in FIG. 15 will be described in detail. While a flying object is being initially accelerated by the expansion of acceleration gas from the gas gun type of initial accelerating apparatus, the flying object is injected through the tapered introducing pipe 23 into the space between the rails 6 of the railgun section. At this time, the flying object is compressed by the frusto-conical inner surface of the tapered introducing pipe 23 and then enters the space between the rails 6 in the railgun section (see 5'). At this moment, the flying object 5' expands radially due to compression forces exerted thereon in the axial direction. Hence, the outer diameter d of the flying object 5' conforms to the diameter D of the space between the rails 6, and a relation of d=D is fulfilled. In addition, when the flying object 5' entering the space between the rails 6 passes discharge needles, a voltage (electric energy) is applied from a discharging power supply of the same type shown in FIGS. 1 and 4 through the discharging needles into the acceleration gas behind the flying object. Hence, the acceleration gas behind the flying object 5 is subjected to dielectric breakdown and is transformed into plasma. This plasma 4 is accelerated by a Lorentz force produced by a current loaded between the pair of rails 6 generated from a pulse shaping network and a magnetic field generated by the plasma itself, whereupon the flying object positioned in front of the plasma 4 is additionally accelerated.

Figure 16:
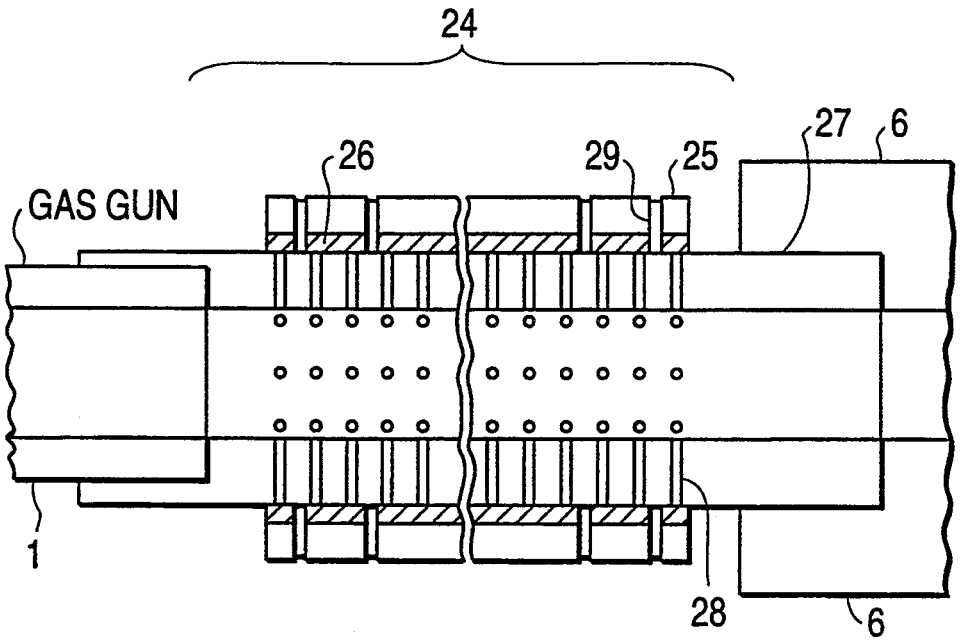
FIG. 16 is a longitudinal sectional view of one preferred embodiment of an introducing pipe portion having a pressure adjusting mechanism according to the present invention.
Figure 17:
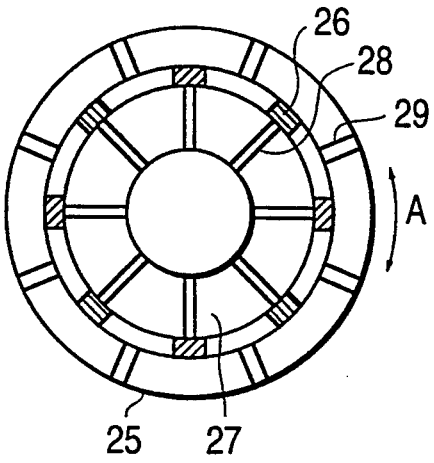
FIGS. 17 and 18 are schematic vertical cross-sectional views of the same pipe portion showing the mode of operation thereof.
Figure 18:
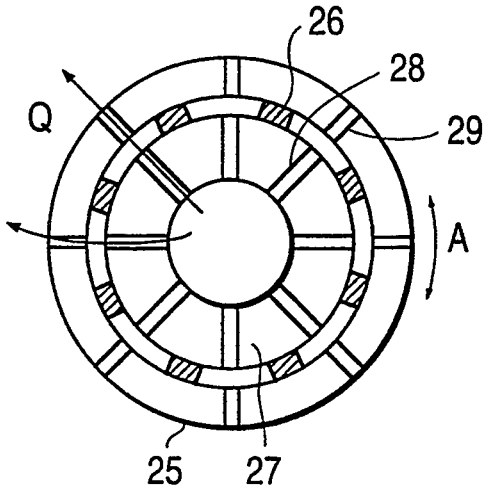

Now a further preferred embodiment shown in FIGS. 16, 17 and 18 will be described. In these figures, reference numeral 1 designates a gas gun type of initial accelerating apparatus, numeral 6 designates rails of a railgun section of the apparatus, and reference numeral 24 designates an introducing pipe associated with pressure adjusting means, which connects the above-mentioned gas gun type of initial accelerating apparatus 1 with the above-described rails 6. The introducing pipe 24 includes an inner introducing pipe portion 27, an outer introducing pipe portion 25, a large number of gas exhaust holes 28 extending radially through the inner introducing pipe portion 27, seal members 26 mounted to the inner circumferential surface of the outer introducing pipe portion 25, and a plurality of gas exhaust holes 29 extending radially through the outer introducing pipe portion 25. The outer introducing pipe portion 25 and the seal members 26 are rotatable around the inner introducing pipe portion 27 in the directions indicated by arrows A, such that the pressure of the acceleration gas can be set at any arbitrary value by increasing or decreasing a number of opened gas exhaust holes 28.

Next, the operation of the railgun accelerating apparatus shown in FIGS. 16, 17 and 18 will be explained in detail. A flying object 5 is injected from the gas gun type of initial accelerating apparatus 1 through the introducing pipe 24 into the space between the rails 6 of the railgun section of the apparatus. At that time, the pressure of the acceleration gas within the introducing pipe 24 which has initially accelerated the flying object is reduced to a pressure appropriate for discharge, that is, for transformation into plasma, by the pressure adjusting means. More particularly, the outer introducing pipe portion 25 and the seal members 26 are rotated around the inner introducing pipe portion 27 (see arrows A) until the gas exhaust holes 29 in the outer introducing pipe portion 25 and the seal members 26 are aligned with the gas exhaust holes 28 in the inner introducing pipe portion 27. Thus, the acceleration gas within the inner introducing pipe portion 27 is released through the gas exhaust holes 28 and the gas exhaust holes 29 to the outside of the outer introducing pipe portion 25 as shown by arrows Q to reduce the pressure of the acceleration gas within the inner introducing pipe portion 27 to a pressure appropriate for discharge, that is, for transformation into plasma. Then, the acceleration gas entering the space between the rails 6 in the railgun section is transformed into plasma by a voltage (electric energy) applied from a discharging power supply. This plasma is accelerated by an electromagnetic force generated by the voltage applied between the rails 6 in the railgun section and by its own magnetic field, and the flying object is additionally accelerated.

Figure 19:
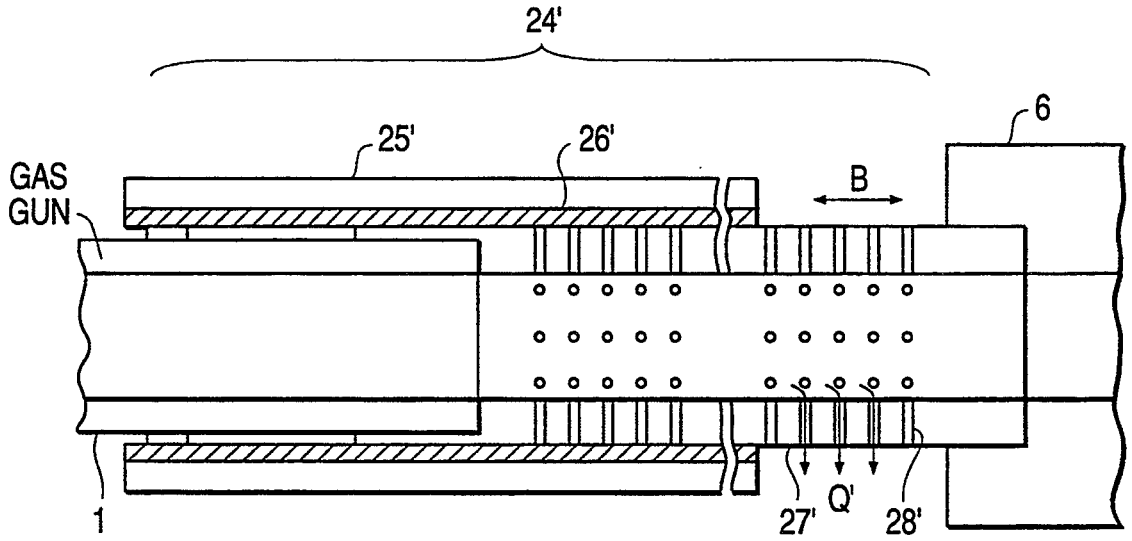
FIG. 19 is a view similar to FIG. 16 of another preferred embodiment of an introducing pipe portion.
Figure 20:
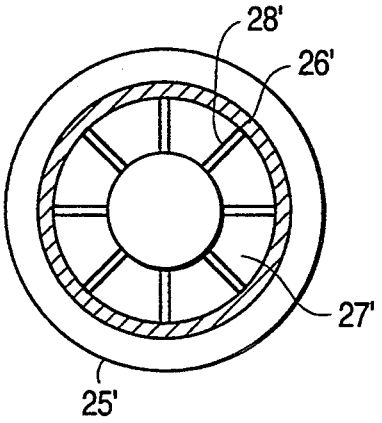
FIG. 20 is a schematic vertical cross-sectional view of the same.
Figure 21:
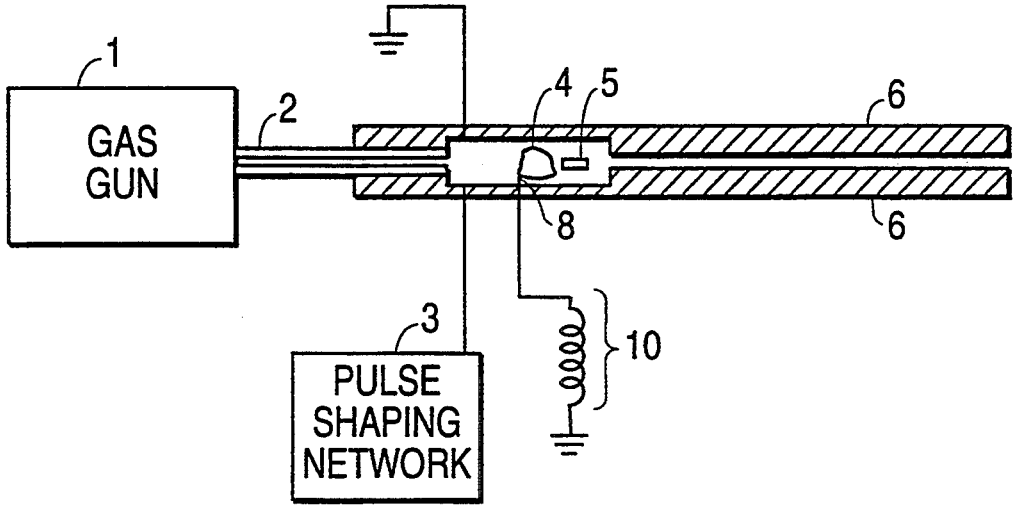
FIG. 21 PRIOR ART
FIG. 21 is a schematic diagram of a two-stage railgun accelerating apparatus in the prior art.
Figure 22:
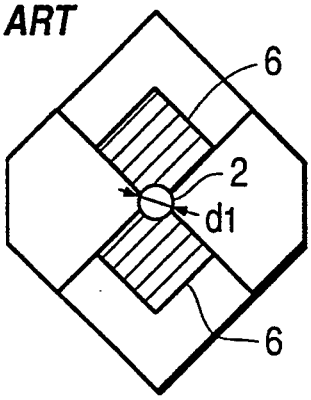
FIG. 22 PRIOR ART
FIG. 22 is a vertical cross-sectional view of an introducing pipe and rails in the prior art railgun.
Figure 23:
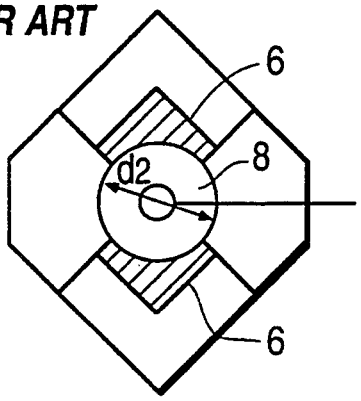
FIG. 23 PRIOR ART
FIG. 23 is a similar vertical cross-sectional view showing rails and needles in the prior art.

FIGS. 19 and 20 illustrate a further preferred embodiment. In this preferred embodiment, an introducing pipe 24' having pressure adjusting means comprises an inner introducing pipe 27', an outer introducing pipe portion 25', a large number of gas exhaust holes 28' extending radially through the inner introducing pipe portion 27', and seal members 26' mounted to the inner circumferential surface of the outer introducing pipe portion 25'. The outer introducing pipe portion 25' and the seal members 26' may be moved in the axial direction of the pipe portions along the outer circumference of the inner introducing pipe portion 27' (in the directions of arrows B) to increase or decrease a number of opened gas exhaust holes 28', whereby the pressure of the acceleration gas may be set at any arbitrary value. The basic operation is the same as that of the preferred embodiment illustrated in FIGS. 16, 17 and 18.

In the method of accelerating a flying object by means of a two-stage railgun accelerating apparatus according to the present invention, as described above, a flying object is initially accelerated by acceleration gas in a gas gun type of initial accelerating apparatus, the object is led to an inlet of a railgun section of the apparatus by means of an introducing pipe, a position and a velocity of the flying object are detected by means of a position detector and a velocity detector provided in the above-mentioned introducing pipe, and depending upon the results of detection, a voltage is applied to the railgun section and a laser beam is irradiated into the acceleration gas just behind the flying object. Accordingly, a dielectric breakdown of the acceleration gas is effected to produce plasma of good quality (plasma having a high density, a large degree of ionization and an excellent electrical conductivity). And since this plasma is used as an armature, in other words, since a discharge trigger for generating plasma is provided by a laser beam, the diameter of the space between the rails can be made nearly equal to the diameter of the introducing pipe. Consequently, the following advantages are obtained.

(1) Collision against protrusions such as needles, rupture and damage of the flying object can be prevented, whereby the stability of the flying object can be insured.

(2) Leakage of the plasma from behind the flying object to the front of the flying object can be prevented, and additional acceleration of the flying object can be achieved effectively.

Figure 24:
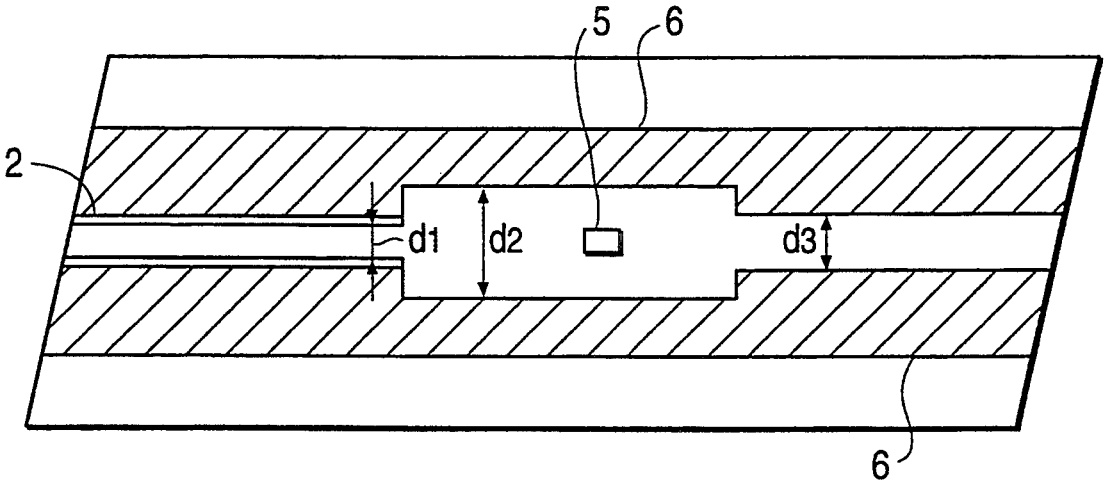
FIG. 24 PRIOR ART
FIG. 24 is an enlarged longitudinal sectional view of an introducing pipe and rails in the prior art.
Figure 25:
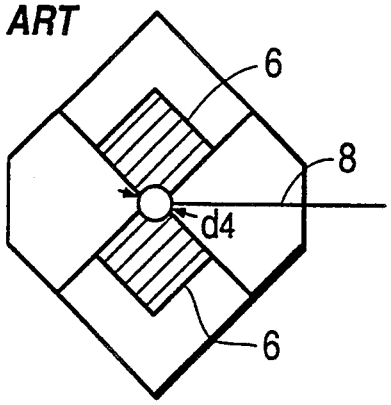
FIG. 25 PRIOR ART
FIG. 25 is a vertical cross-sectional view showing the rails and needles in the prior art.
Figure 26:
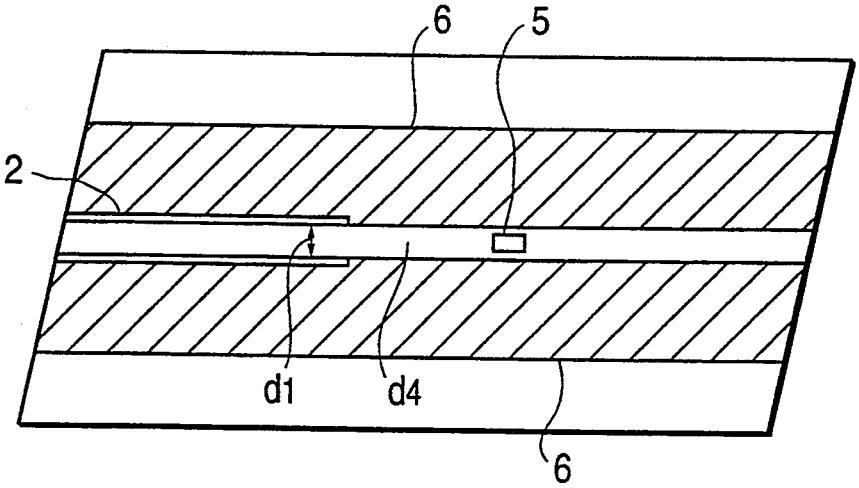
FIG. 26 PRIOR ART
FIG. 26 is an enlarged longitudinal sectional view of an introducing pipe and rails in the prior art.

(3) Because the flying object does not enter a space between the rails corresponding to the space having a diameter $d_3$ in FIG. 24, the flying object can be made to run soundly.

(4) Energy acting as a discharge trigger for breaking down the acceleration gas is generated by a laser beam. Therefore, even if the pressure of the acceleration gas is high, the transformation of the acceleration gas into plasma can be achieved easily, and a large capacity discharging power supply for effecting transformation of the gas into plasma is unnecessary. For instance, according to the above-described at of the Illinois University in U.S.A., in the case where plasma was produced according to the heretofore known method and was accelerated, the resistance of the plasma and the rails was about 0.4Ω, and the plasma had a low density and degree of ionization. Accordingly, a resistance of the plasma is high. Hence, even if it is intended to accelerate the plasma by applying a high voltage of 10 KV from the pulse shaping network, only a current of 23.5 KA flows through the plasma. Therefore, an electromagnetic force (Lorentz force) acting upon the plasma is too small to achieve sufficient acceleration of the plasma and sufficient additional acceleration of the flying object.

(5) Even if the pressure of the acceleration gas is kept high, plasma can be produced at a predetermined region of the gas by the laser beam. In addition, in a region of the acceleration gas where plasma is not generated by the laser beam (because of excessively high pressure), unnecessary plasma will not be produced.

(6) As a result of the fact that plasma is produced by a laser beam, plasma of good quality having a high density and a high ionization degree can be obtained, and so a high acceleration efficiency can be achieved. For instance, if the acceleration gas is irradiated with a ruby laser beam of 44 MW for $25\times10^{-9}$ sec. to transform the acceleration gas at about 7,000 Torr into plasma, a resistance of the plasma and the rails is about 0.03Ω, and the plasma has high density and a high degree of ionization. Accordingly, because of the low resistance of the plasma, in the case where the plasma is accelerated by applying a voltage of 2.5 KV from the pulse shaping network to the rails, a current of about 88 KA flows through the plasma. Hence a large electromagnetic force (Lorentz force) acting upon the plasma can be insured, and acceleration of the plasma and additional acceleration of the flying object can be achieved sufficiently (see the previously disclosed table).

In addition, in the railgun type accelerating apparatus according to the present invention, as described above, differences in the inter-rail distance are relatively small to inhibit the concentration of current and plasma. And, by employing an oval or elliptical passageway, the circumferential portions of the rails where current and plasma concentrate are considerably large thereby preventing a concentration of heat thereat, and the corners of the flying object passageway in the railgun section are curved to conform to the flying object so as to prevent plasma from leaking to the front of the object. Therefore, the accelerating apparatus has the advantage that the flying object can be additionally accelerated in an efficient manner.

While a principle of the present invention has been described above in connection with a number of preferred embodiments of the invention, it is a matter of course that many apparently widely different embodiments of the present invention could be made without departing from the spirit of the present invention.

What is claimed is:

1. A two-stage railgun accelerating apparatus for accelerating an object, said apparatus comprising:

an initial accelerating device including a gas gun having means for generating acceleration gas under pressure to initially accelerate an object in the apparatus;

a railgun section including a pair of spaced apart rails defining a flying object passageway therebetween;

an introducing pipe extending between said initial accelerating device and said railgun section so as to direct the initially accelerated object toward the flying object passageway, said introducing pipe including an inner introducing pipe having holes extending radially therethrough, and an outer introducing pipe extending around said inner introducing pipe, said outer introducing pipe having holes extending radially therethrough, and said outer introducing pipe being rotatable relative to said inner introducing pipe so that the pressure of accelerating gas passing through the introducing pipe is adjustable by rotating the outer introducing pipe relative to the inner introducing pipe;

power supply means for applying a voltage between the rails of said railgun section.

* * * * *